United States Patent [19]

Orbans

[11] 4,349,911

[45] Sep. 14, 1982

[54] SAFETY DEVICE FOR ELECTRODES OF AN ELECTRIC STEEL-MAKING FURNACE

[76] Inventor: Joseph M. W. Orbans, rue Simon Radoux, 1, 4000 Liege, Belgium

[21] Appl. No.: 213,378

[22] Filed: Dec. 5, 1980

[30] Foreign Application Priority Data

Dec. 6, 1979 [BE] Belgium ..... 198456

[51] Int. Cl.[3] ..... H05B 7/148

[52] U.S. Cl. ..... 373/105

[58] Field of Search ..... 13/9 R, 12, 13

[56] References Cited

U.S. PATENT DOCUMENTS 2,942,138 6/1960 Carr et al. ..... 13/13 X 3,617,595 11/1971 Mulcahy ..... 13/13

*Primary Examiner*—Roy N. Envall, Jr.

*Attorney, Agent, or Firm*—McCormick, Paulding & Huber

[57] ABSTRACT

An electronic safety device for the electrodes of an electric steel-making furnace in which the position of the electrodes is controlled by a position-regulating device. The safety device is adapted to detect when an electrode has been brought to a stop and automatically raise the electrode if it has not been stopped in response to an order to stop from the position-regulating device.

4 Claims, 1 Drawing Figure

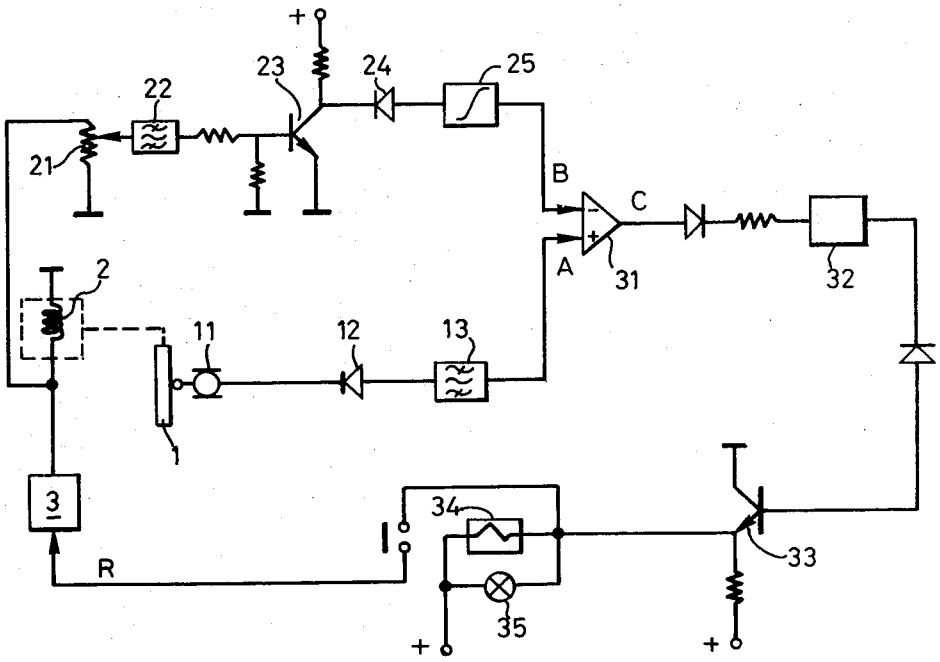
32
33
C
31
B
A
25
13
35
34
24
12
23
11
22
2
21
3
R
+
+
+

SAFETY DEVICE FOR ELECTRODES OF AN ELECTRIC STEEL-MAKING FURNACE

BACKGROUND OF THE INVENTION

The invention relates to a device for detecting contact between a material which does not conduct electricity and an electrode of an electric steel-making furnace.

In an electric steel-making furnace, steel is produced by melting scrap metal in contact with electrodes supplied with a high-intensity electric current. During operation of such a furnace, the electrodes are brought into intimate contact with the scrap charge by being moved under the control of an electric position-regulating device, so that the ends of the electrodes are immersed in the charge of scrap which is to be melted. A position-regulating device of the aforementioned kind is known and, for each electrode, produces a motion-control signal which varies inversely with the electric current flowing through the electrode.

Usually, however, the charge is not uniform and the electrode frequently comes in contact with a material in the charge which does not conduct electricity (e.g. lime, stone or wood). Such a material constitutes an electric resistance through which only a very weak current travels. The result is that the electric position regulating device generates a maximum regulating current, and thus the position regulating device operates to exert a continuous pressure on the electrode. Thereupon, the mechanical resistance of the non-conductive material to any motion of the electrode becomes such that the continuous pressure exerted by the regulating device rapidly breaks the electrode, which then has to be replaced. Electrodes are relatively expensive (over $2,250 at present) and in addition whenever an electrode is broken the furnace must be stopped, which automatically results in appreciable loss of production. The effect of such stoppages on production can easily be estimated from the fact that these stoppages normally last an hour or more and it is common for such stoppages to recur several times in a day.

Faulty operation may also be caused by an electrode which is too short or which is becoming too short as a result of wear. In that case, the arc between the electrode and the charge of scrap radiates under the furnace arc with an intensity which rapidly damages the refractory lining.

Owing to the harmful consequences of such incidents, it is desirable to detect them and remedy them without delay. The basic problem is permanently to check that an order from the regulating device is always effectively carried out and that an electrode is never held stationary when it receives an order to move from the regulating device.

OBJECT OF THE INVENTION

To this end, the invention seeks to provide an electronic device adapted to detect when an electrode is held stationary and to raise it if the stoppage is not in response to an order to stop from a position-regulating device.

BRIEF SUMMARY OF THE INVENTION

The device according to the invention comprises first means connected to measure the regulating current and to produce a set-value signal corresponding to an adjustable predetermined threshold value of the regulating current. Second means are coupled to the electrode-holder for detecting whether the electrode is moving and to produce an electric signal having a first state when the electrode moves and a second state when the electrode is at a stop. A comparator device is connected to receive the set-value signal at a first input and to receive the electric signal produced by the second means at a second input, the comparator device being adapted to produce a control signal having two states, namely a first state in response to two simultaneous input signal each having a first predetermined state and a second state in response to two simultaneous input signals having different states, the control signal being applied to a control input of the regulating device so that when the electrode does not move in response to a regulating current in excess of said threshold regulating current the regulating device automatically raises the electrode.

INTRODUCTION TO THE DRAWING

The invention will now be explained in greater detail by way of example with reference to the single accompanying drawing, which is a simplified diagram of the electric circuit of a device in accordance with the invention.

DESCRIPTION OF PREFERRED EMBODIMENT

In the drawing, one of the electrodes of an electric furnace (not shown) is mounted on a holder 1. The motion of the holder 1 is controlled by a known electro-hydraulic regulator 2 which responds to the current produced by an electronic regulating device 3. The regulator 2 has an excitation winding for each electrode. In a known manner, the motion of holder 1 is related to the regulating current produced by device 3.

The object of the device according to the invention is to detect when the value of the regulating current exceeds a preset threshold and to check that holder 1 is in fact moving under the control of the excitation current. In the particular example described, the regulating current normally varies from 0 to + 100 mA or from 0 to − 100 mA and the threshold is set at + 25 mA.

The device according to the invention comprises an electronic assembly for each electrode. The assemblies are all alike and only one is diagrammatically shown in the drawing. As the diagram shows, the assembly is basically made up of three circuits.

A first circuit is adapted to detect whether the holder is moving or at a stop. The holder is coupled to a device, e.g. a well-known tachometric dynamo, which produces a signal in dependence on the speed at which the holder moves. Let "1" be the state of the signal when the holder is moving and "0" be the state of the signal when the holder is at a stop. The motion-measuring signal A is taken via a blocking diode 12 and filtered in filter 13.

A second circuit is adapted to produce a set-value signal based on a measurement of the regulating current. A potentiometer 21 is connected to the terminals of the excitation winding of the regulator 2. A voltage adjusted in proportion to the regulating current through winding 2 appears on the moving contact of potentiometer 21. An electric filter 22 filters the superposed a.c. component. The filtered voltage is applied to the base of a transistor 23 adapted to be conductive at a low voltage corresponding to a regulating current of e.g. 25 mA. As soon as this threshold is reached, transistor 23 becomes conductive and a "0" signal appears on its collector. After a blocking diode 24, an integrating circuit 25 integrates the set-value signal B over a chosen period of e.g. 7 ms, in order not to take account of any signal lasting less than a minimum time and thus eliminate any instability of the system through "hunting".

The signals obtained at the outputs of the aforementioned two first circuits are applied to the third circuit, which basically comprises a comparator 31, e.g. an operational amplifier. The inverting input is connected to receive the set-value signal B and the non-inverting input is connected to receive the motion signal A. During normal operation, when the corresponding electrode is properly in contact with the charge of scrap, the two input signals are at state "1" and the output signal C of amplifier 31 is at state "0". When, on the other hand, the set-value signal B is at state "1" whereas the motion signal is at state "0" (corresponding to the case when the electrode is held stationary in spite of an order to move received from the regulator), the output signal of amplifier 31 is at state "1". After a slight delay, e.g. of the order of 0.5 seconds, produced on the time constant circuit 32, the signal C is applied to the base of a transistor 33 which then becomes conductive and actuates the control relay 34, whereupon a tell-tale lamp 35 is switched on. Relay 34 applies a control signal R to the regulating device 3 in order to raise the electrode. Advantageously relay 34 has a check circuit which stores the raising signal until the defect has been substantially eliminated by modifying the furnace charge.

What I claim is:

1. A safety device for protecting electrodes in an electric steel-making furnace, comprising a regulating device for producing a current regulating the motion of each electrode in dependence on the current travelling through the electrode, said safety device comprising:

first means connected to measure the regulating current and to produce set-value signal whenever a predetermined threshold value of the regulating current is exceeded;

second means coupled to the electrode-holder for detecting whether the electrode is moving and producing and electric signal having a first state when the electrode moves and a second state when the electrode is at a stop; and a comparator device connected to receive the set-value signal at a first input and to receive the electric signal produced by the second means at a second input, the comparator device being adapted to produce a control signal having two states, namely a first state in response to two simultaneous input signals each having a first predetermined state and a second state in response to two simultaneous input signals having different states, the control signal being applied to a control input of the regulating device so that when the electrode does not move in response to a regulating current in excess of said threshold regulating current the regulating device automatically raises the electrode.

2. A device according to claim 1, in which an integrating circuit is connected between the input of the first means and the first input of the comparator device so that the set-value signal will not be applied to the comparator unless it lasts for a predetermined minimum time.

3. A device according to claim 1, in which a delay circuit is connected between the output of the second means and the second input of the comparator device.

4. A device according to claim 1, in which the first means comprise a potentiometric assembly connected to a conductor through which the regulating current flows, a filter connected to the output of the potentiometric assembly, and a switch connected to the output of the filter, the switch being adjusted so as to be switched after receiving an input signal which exceeds a preset threshold value.

* * * * *